US006354767B1

(12) United States Patent
Jones

(10) Patent No.: US 6,354,767 B1
(45) Date of Patent: Mar. 12, 2002

(54) PILE GUIDE FOR SUPPORTING A PILE AS IT IS DRIVEN INTO A SUBSTRATE AND THE METHOD OF USING THE SAME

(75) Inventor: Clive Jones, Dorchester Dorset (GB)

(73) Assignee: Fast Frames U.K. Limited (GB)

( * ) Notice: Subject to any disclaimer, the term of this patent is extended or adjusted under 35 U.S.C. 154(b) by 0 days.

(21) Appl. No.: 09/486,320

(22) PCT Filed: Aug. 27, 1998

(86) PCT No.: PCT/GB98/02541

§ 371 Date: Feb. 25, 2000

§ 102(e) Date: Feb. 25, 2000

(87) PCT Pub. No.: WO99/11872

PCT Pub. Date: Mar. 11, 1999

(30) Foreign Application Priority Data

Aug. 28, 1997 (GB) ..... 9718056
Sep. 27, 1997 (GB) ..... 9720500

(51) Int. Cl.[7] ..... E02D 7/02
(52) U.S. Cl. ..... 405/232; 405/228
(58) Field of Search ..... 405/224, 195.1, 405/227, 228, 231, 232

(56) References Cited

U.S. PATENT DOCUMENTS 3,345,879 A 10/1967 Nasu et al.
3,604,519 A 9/1971 Chelminski
3,998,064 A 12/1976 Jansz
4,102,147 A 7/1978 Jansz
4,154,552 A 5/1979 Van Bilderbeck
4,509,883 A * 4/1985 Thibodeaux et al. ..... 405/232
4,697,959 A * 10/1987 Kinnan ..... 405/232
4,740,108 A * 4/1988 Levee et al. ..... 405/221
4,932,811 A * 6/1990 Folding ..... 405/227
5,304,015 A * 4/1994 Sonomura ..... 405/232
5,332,047 A * 7/1994 Hignite ..... 173/1
5,558,469 A * 9/1996 Hellerman ..... 405/232
6,042,304 A * 3/2000 Manning ..... 405/232 X

* cited by examiner

*Primary Examiner*—David Bagnell
*Assistant Examiner*—Sunil Singh
(74) *Attorney, Agent, or Firm*—Wall Marjama & Bilinski, LLP

(57) ABSTRACT

A pile guide (1) has an open-ended tubular guide member (3), supported on base frame (2), which is adapted slidingly to receive a pile (7) to be driven into the seabed (9) by a hammer (6). The tubular guide member (3) comprises two parts (4) which are held together in the operative position by a latch (14). As the pile (7) is driven into the seabed (9), latch trigger (8) disengages the latch (14) causing the parts (4) to rotate under gravity about points (12) away from the pile (7). As soon as the parts (4) are remote from the pile (7), the pile (7) may be driven fully into the seabed without the hammer fouling the guide member (3).

19 Claims, 3 Drawing Sheets

PILE GUIDE FOR SUPPORTING A PILE AS IT IS DRIVEN INTO A SUBSTRATE AND THE METHOD OF USING THE SAME

TECHNICAL FIELD

The invention relates to pile driving, and more particularly, but not exclusively, to underwater pile driving, e.g. for stabbing piles directly into the seabed.

BACKGROUND ART

It is known to provide a guide for aligning a pile with the surface of a substrate into which the pile is to be driven and to provide stability for a piling hammer. Particularly when piling underwater there is the problem that after the pile has been introduced into the seabed or the like, the guide must be removed to allow the pile to be driven into its final position. This guide removal is time consuming and thus expensive.

It is an object of the invention to provide a stabilising guide for a pile which can be moved out of the way after a pile has first been established in its substrate to enable the pile driving to continue to drive the pile into its final position without any need to stop the driving to remove the guide.

DISCLOSURE OF THE INVENTION

According to a first aspect of the invention a pile guide comprises a guide member adapted to be supported on a substrate into which the pile is to be driven, means mounting the guide member in an operative position in which it can support a pile and hammer and permitting movement of the guide member into an inoperative position in which the guide member is remote from the pile, and latch means for holding the guide member in its operative position, the latch means co-operating with means on or associated with the pile to unlatch the guide member after the pile has been inserted to a predetermined extent to allow the guide member to move to its inoperative position.

The guide member may comprise a pair of generally semi-cylindrical members which together form a tubular member for enclosing the pile.

The guide member may be hinged on the mounting means. Thus the pair of semi-cylindrical members may be hinged on the mounting means at their bottom ends so that they move away from the pile in opposed directions. Means for moving the guide member into its inoperative position, e.g. spring means, may be provided but preferably the guide member is urged into its inoperative position by gravity.

The pile guide may comprise lifting means which also causes the pile guide member to assume its operative position.

The means on the pile to unlatch the guide member may comprise a detent member attached (e.g. welded) to the pile.

The mounting means may comprise a base frame adapted to rest on the substrate (e.g. seabed) to support the guide member in position. The base frame may surround the guide member. The base frame may, however, be formed with an aperture or slot extending therethrough to facilitate removal of the pile guide from rigging or a tether attached to a pile driven into the seabed. The guide member may have groove means for receiving rigging or a tether attached to a pile passing through the guide member.

In accordance with a second aspect of the present invention, there is provided a method of driving a pile into a substrate, comprising: providing a pile guide in accordance with the first aspect of the present invention; providing means on or associated with the pile to unlatch the guide member after the pile has been inserted to a predetermined extent to move the guide member to its inoperative position; supporting the pile with the guide member in the operative position; and driving the pile into the substrate to an extent beyond the predetermined extent without removing the pile guide.

In accordance with a further aspect of the present invention, there is provided a pile guide comprising a guide member adapted to be supported on substrate into which a pile is to be driven, characterised in that the guide member comprises at least two parts, and by comprising means for moving the at least two parts between an operative position for supporting the pile and hammer and an inoperative position remote from the pile when the pile has been driven into the substrate to a predetermined extent. In the inoperative position, there is sufficient clearance to avoid the hammer fouling the at least two parts when the pile is driven beyond the predetermined extent, without the need to remove the pile guide itself.

The pile guide may further comprise a means for retaining the at least two parts in the operative position, the at least two parts having biasing means which urge the at least two parts into the inoperative position when the retaining means is disengaged. The retaining means may comprise latch means for latching the at least two parts together in the operative position, the latching means co-operating with trigger means on or associated with the pile to unlatch the at least two parts when the pile has been driven into the substrate to the predetermined extent. The biasing means may comprise counter weights which act under gravity.

The invention thus provides a simple mechanism which avoids the downtime required by conventional guides in removing the guide frame or piling hammer part way through the pile driving process.

BRIEF DESCRIPTION OF THE DRAWINGS

An embodiment of the invention is illustrated, by way of example, in the accompanying drawings, in which.

MODE OF CARRYING OUT THE INVENTION

Figure 2:
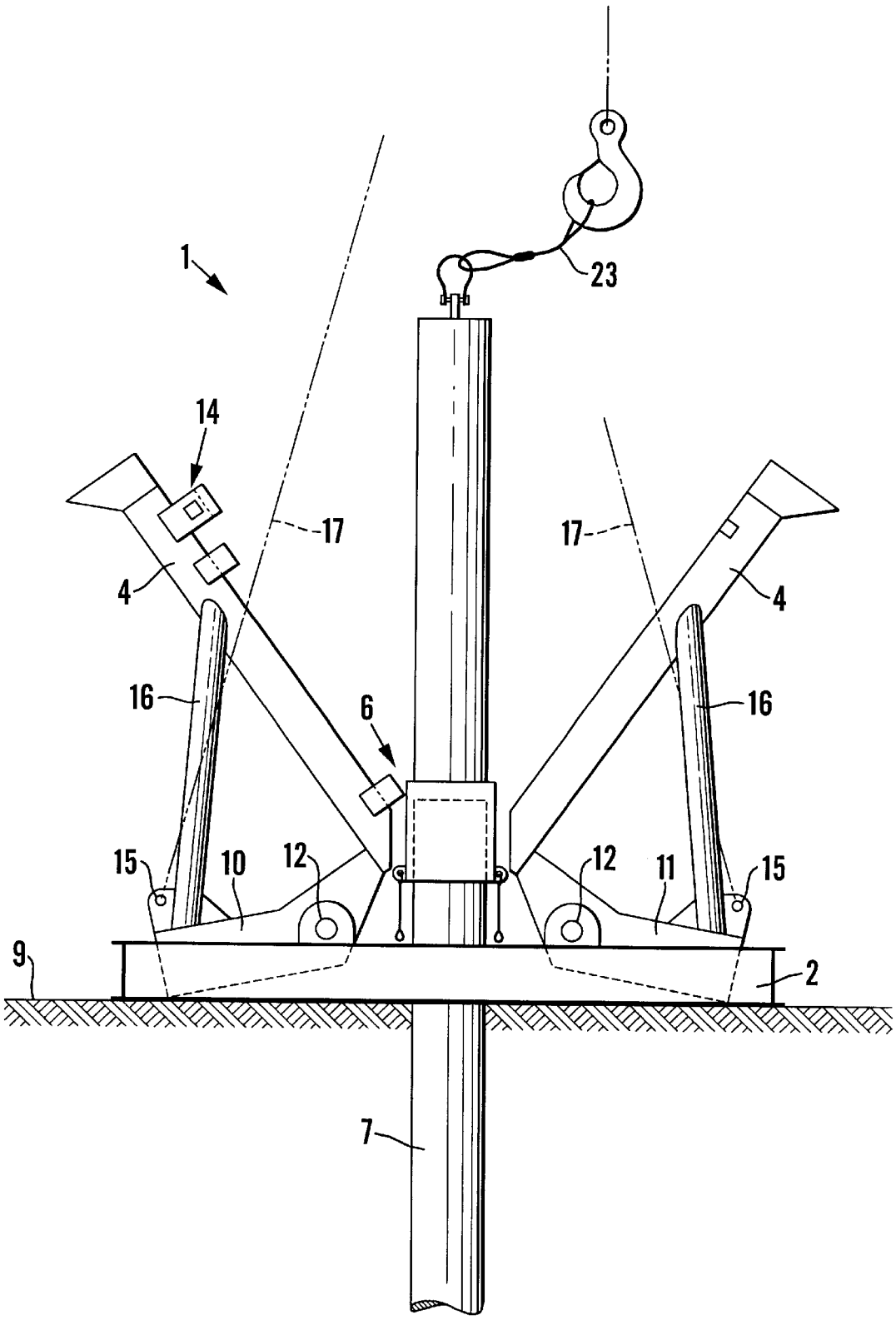
FIG. 2 is a side view generally similar to that of FIG. 1 showing the pile guide in its inoperative condition.

In the drawings a pile guide (1) comprises a base frame (2) adapted to rest on the seabed (9) to support the guide in position. The guide (1) has an open-ended generally vertical tubular guide member (3) supported on the base frame (2) and adapted slidingly to receive a pile (7) to be driven into the seabed (9) by means of a hammer (6) connected to rigging (23), see FIG. 2. The upper end (5) of the member (4) is flared outwardly to form a guide cone to facilitate entry of a pile (7) into the guide.

Figure 1:
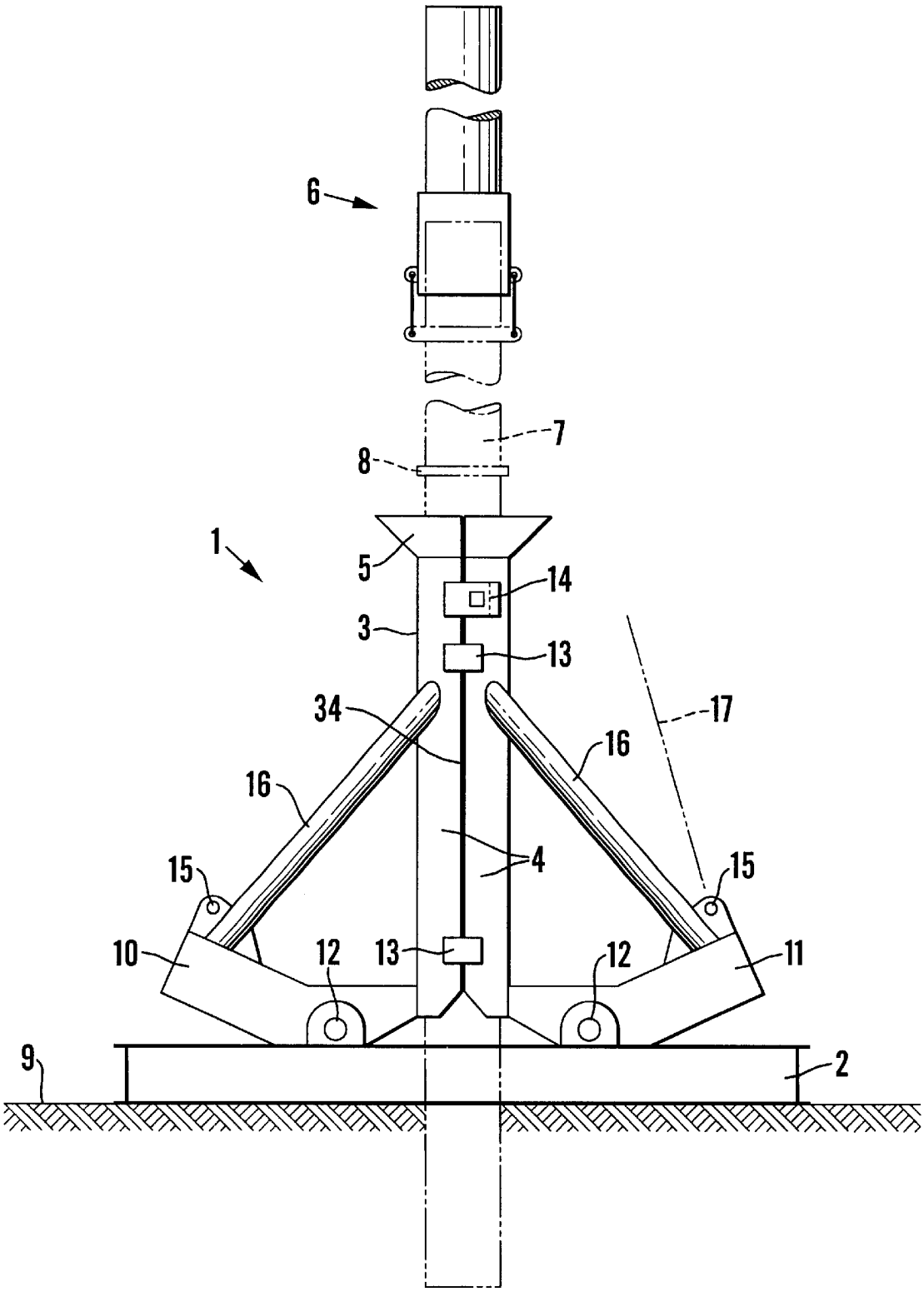
FIG. 1 is a side elevation of a pile guide for underwater pile driving shown in its operative condition.

The tubular guide member (3) comprises two similar semi-cylindrical parts (4), which as shown in FIG. 1 are held together by a latch (14), more fully described below, and by alignment plates (13). Each part (4) is pivotally mounted at points (12) on the base frame (2) for movement between the working or closed position shown in FIG. 1 and the inoperative or open position shown in FIG. 2. The respective parts (4) are mounted on counterweighted arms (10,11) which are pivoted on the base frame (2) such that the arms (10,11) are biased under gravity into the positions shown in FIG. 2.

Braces (16) connect the outer ends of the arms (10, 11) and upper portions of the parts (4) in the interests of rigidity.

Figure 3A:
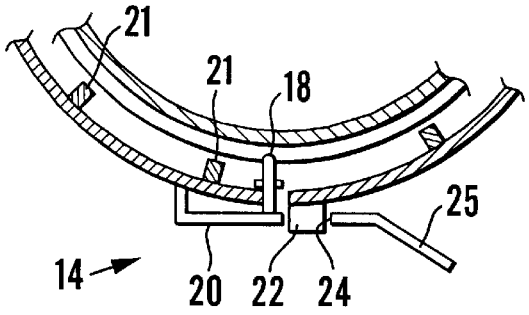
FIG. 3*a* comprises a plan sectional view of a latch mechanism for the pile guide of FIG. 1.
Figure 3B:
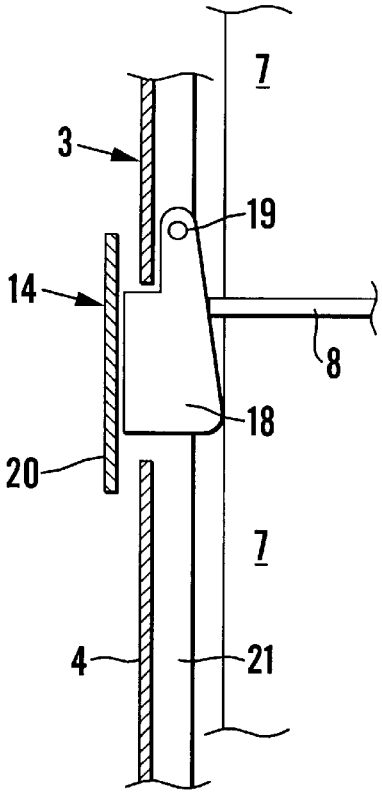
FIG. 3*b* comprises a side sectional view of the latch mechanism of FIG. 3*a,* and FIG. 4 is a plan view of a base frame for the pile guide of FIG. 1.

As shown in FIG. 3, each latch (14) comprises a spring-loaded plate (20) secured to one part (4) and formed with an aperture (24) which receives a lock bar (22) secured to the other part (4). The plate (20) is formed with an outwardly flared end (25) to guide the lock bar (22) into the aperture (24) in the plate (20). The latch (14) is disengaged by downward movement of the pile (7) as it is driven into the seabed (9). The pile is provided with a latch trigger or detent (8) which engages a latch plate (18) pivoted on a part (4) and which is rotated by continued downward movement of the trigger (8) to push the plate (20) outwardly so that the bar (22) is released from the aperture (24). (Spacers (21) are provided on the inner periphery of the parts (4) to centre piles which have a smaller diameter than the guide member (3).) The parts (4) then fall under gravity into the position shown in FIG. 2.

In this way it is possible to continue driving the pile into the seabed without the need for removing the guide from the pile or the hammer from the pile as is necessary with conventional pile guide frames, since the two halves or parts (4) of the guide are moved clear of the pile and the driving hammer (6).

The pile guide is moved back into its working condition by operation of slings or cables (17) arranged to lift the pile guide, the slings (17) being connected to lifting eyes (15) on the outer ends of the arms (10,11), the weight of the pile guide being sufficient so that the arms are rotated into the position shown in FIG. 1 during such lifting. Of course, during driving the slings (17) are slack to allow the frame (2) to sit fully on the seabed.

Figure 4:
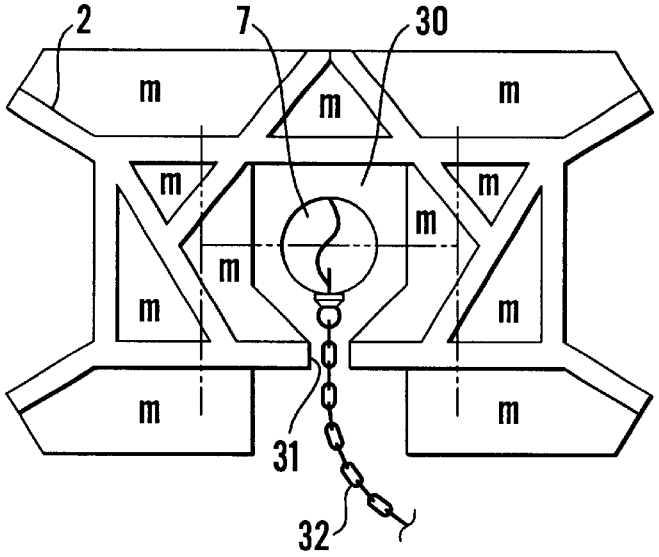

FIG. 4 shows the base frame (2) in plane view, in which it has a substantially rectangular footprint (made up of mud mats M) with a centrally placed aperture (30) through which the pile (7) is guided. (In FIG. 4, the guide member (3) and counterweight assembly have been omitted for the sake of clarity.) The base frame thus surrounds the pile. It will be seen, however, that the base frame is formed with an aperture or slot (31) extending through the frame from its exterior to the central aperture (30) and through which a tether or rigging (32) fixed to the pile (7) can be passed to disengage the pile guide (1) from the pile. As shown in FIG. 1, the guide member (3), FIG. 1, can further include a groove 34 between the two parts 4 for receiving rigging or a tether attached to a pile passing through the guide member.

What is claimed is:

1. A pile guide for supporting a pile as it is driven into a substrate, comprising:

a guide member comprising a first part and a second part, the parts being movable between an operative position with the guide member supporting the pile, and an inoperative position with the guide member clear of the pile;

a mount for mounting the parts of the guide member in the operative position;

a latch mechanism for retaining the parts of the guide member in the operative position, and releasing the parts when the latch mechanism is disengaged;

a biasing arrangement for urging the parts of the guide member into the inoperative position upon disengagement of the latch mechanism, and wherein the latch mechanism is configured to be disengaged by the pile after the pile is driven relative to the guide member a predetermined extent.

2. A pile guide according to claim 1, in which the parts of the guide member together form a hollow member for enclosing the pile.

3. A pile guide according to claim 2, in which the parts are semi-cylindrical, the hollow member having a circular cross-section.

4. A pile guide according to claim 1, in which the parts of the guide member are movable on hinges on the mount to provide pivotable movement between the operative and inoperative positions.

5. A pile guide according to claim 4, in which the parts of the guide member are hinged at their bottom ends so that they are pivotablc away from the pile being driven into a substrate.

6. A pile guide according to claim 1, in which the biasing arrangement for urging the at least two parts into the inoperative position comprises counterweights which act under gravity.

7. A pile guide according to claim 1, further comprising lifting attachments positioned to restore the parts of the guide member to the operative position from the inoperative position when lifted.

8. A pile guide according to claim 1, in which the mount comprises a base frame which, in use, rests on a substrate.

9. A pile guide according to claim 8, in which the base frame at least partially surrounds the guide member.

10. A pile guide according to claim 9, in which the base frame has a periphery and is provided with an aperture extending from the guide member to the base periphery, the aperture facilitating removal of the pile guide from rigging or a tether attached to a pile driven into the substrate.

11. A pile guide according to claim 10, in which the guide member is provided with a groove for receiving a tether attached to a pile passing through the guide member.

12. A pile guide according to claim 1, wherein the latch mechanism comprises a spring-loaded plate, including an aperture, on one of the parts of the guide member, and a lock bar, on the other part of the guide member, wherein the lock bar is received in the aperture in the operative position of the guide member and a hinged plate configured so that it releases the lock bar from the aperture of the spring-loaded plate as the pile is driven into a substrate.

13. A method of driving a pile into a substrate comprising:

providing a pile guide, the pile guide including a guide member having at least two parts which are movable between an operative position and an inoperative position, and a latch mechanism for retaining the at least two parts in the operative position, the latch mechanism being configured to be disengaged by the pile after the pile is driven relative to the guide member a predetermined extent;

supporting the pile with the guide member in the operative position; and driving the pile into the substrate to an extent beyond the predetermined extent without removing the pile guide, so that the pile disengages the latch mechanism and the at least two parts of the guide member move in to the inoperative position.

14. A method according to claim 13, in which the substrate is under water.

15. A method according to claim 13, in which the guide member parts pivot downwardly from the operative position to the inoperative position.

16. An assembly comprising a pile guide and a pile supported by the pile guide as it is driven into a substrate, wherein the pile guide comprises:

a guide member comprising at least two parts configured to support the pile and movable between an operative position with the guide member supporting the pile, and an inoperative position with the guide member clear of the pile;

a mount for mounting the at least two parts of the guide member;

a latch mechanism and configured to retain the at least two parts of the guide member in the operative position, and to release the at least two parts when disengaged, and a biasing arrangement for urging the at least two parts of the guide member into the inoperative position upon disengagement of the latch mechanism; and wherein the pile includes a trigger, which is configured to disengage the latching mechanism after the pile is driven into the substrate a predetermined extent.

17. An assembly according to claim 16, in which the trigger is a detent member which is attached to the pile.

18. A pile guide for supporting a pile as it is driven into a substrate, comprising:

a guide member comprising at least two parts for supporting the pile and movable between an operative position with the guide member supporting the pile, and an inoperative position with the guide member clear of the pile;

a mount for mounting the at least two parts of the guide member in the operative position;

a latch for retaining the at least two parts of the guide member in the operative position, and releasing the at least two parts when the latch is disengaged; and a counterweight biasing arrangement for urging downwards pivotal movement of the at least two parts of the guide member into the inoperative position upon disengagement of the latch.

19. A pile guide according to claim 18, wherein the mount comprises a base frame, with the at least two guide member parts connected to hinges on the base frame via their bottom ends so that they are downwardly pivotable by the counterweight biasing arrangement.

* * * * *